United States Patent [19]

Cooper, III et al.

[11] 3,950,864

[45] Apr. 20, 1976

[54] SHOE REINFORCING METHOD

[75] Inventors: Henry E. Cooper, III, Waltham; Edward E. Gendreau, Dracut, both of Mass.

[73] Assignee: The Terrell Corporation, Wilmington, Mass.

[22] Filed: June 20, 1975

[21] Appl. No.: 588,808

Related U.S. Application Data

[60] Division of Ser. No. 423,714, Dec. 11, 1973, which is a continuation of Ser. No. 236,220, March 20, 1972, abandoned, which is a continuation-in-part of Ser. No. 42,554, June 1, 1970, abandoned.

[52] U.S. Cl. ..... 12/146 D

[51] Int. Cl.[2] ..... A43D 00/00

[58] Field of Search ..... 12/146 R, 146 D; 36/68, 36/69

[56] References Cited

UNITED STATES PATENTS

| | | | |
|---|---|---|---|
| 2,447,681 | 8/1948 | Beckwith et al. | 12/146 D |
| 3,053,292 | 5/1962 | Heaton et al. | 12/146 D |
| 3,602,931 | 9/1971 | MacArthur | 12/146 D |

*Primary Examiner*—Patrick D. Lawson

*Attorney, Agent, or Firm*—Robert E. Meyer

[57] ABSTRACT

This invention relates to a method for stiffening and reinforcing shoes and to a material for use in that method. The material comprises a mixture of a thermoplastic resin having a melt flow rate of at least 1 gram in 10 minutes at a temperature of 100° C. and a pressure of 250 psi with 5 to 25 per cent by weight of the total composition of short (i.e. 1/32 to ½ inch) fibers, preferably chopped or milled glass fibers. Minor proportions of non-fibrous fillers may be added.

6 Claims, No Drawings

SHOE REINFORCING METHOD

This application is a division of application Ser. No. 423,714, filed Dec. 11, 1973, which in turn is a continuation of our prior then copending application Ser. No. 236,220, filed Mar. 20, 1972 (now abandoned), which in turn is a continuation-in-part of our prior then copending application Ser. No. 42,554, filed June 1, 1970 (now abandoned).

SUMMARY OF THE INVENTION

In normal shoe construction it is customary to provide reinforcing and stiffening elements for various parts of the shoe. Typically these reinforcing elements are provided at the heel (the counter) and at the toe (the box toe). Because of the shape of the normal shoe both the counter and the box toe have to assume a rather complex three-dimensional shape. To insure the comfort of the wearer the inner surface should be smooth and unwrinkled. In addition the edges of stiffening-reinforcing elements should be tapered gradually in thickness to avoid the discomfort caused by an abrupt change in thickness and to present a smooth, nice-looking exterior appearance.

For many years the stiffening elements used in the heel area have been pre-molded to shape and size from materials such as resin-impregnated fiberboard and leather. While this type of pre-molded counter is still used on many types of shoes, primarily men's dress shoes, work shoes, ski boots, and the like, it has many disadvantages. One of these is that in order to insure a good fit and to avoid bunching and wrinkling during lasting a large number of different shapes and sizes must be inventoried. Another is that the insertion of the molded member interferes with the desired combining of lasting operations.

In recent years of a number of different proposals have been made whereby the heel reinforcing member could be assembled into the upper in a flat condition, and thereafter molded into the desired shape prior to or during lasting. To accomplish this the reinforcing element must in some way or other be activated so that it is flaccid enough during lasting to be moldable and yet in the finished shoe will have the desired stiffness. There have been a number of proposals for accomplishing this. For example, one might impregnate a piece pre-cut from suitable web, normally a napped felt-like fibrous web, with a solvent or an aqueous resinous composition, insert the still wet element into the counter pocket and permit it to dry on the last.

A more popular expedient has been to pre-impregnate a fibrous web with a resin and to supply it in a dry partially stiffened condition. The individual reinforcing elements are cut from the web and the elements are dipped into a solvent. The solvent softens the resin impregnant and reduces the web to a flaccid condition. The element while in this solvent moistened flaccid condition is inserted into the counter pocket. The upper is then lasted and the subsequent drying of the solvent results in the return of the elements to a stiffened state taking the shape of the last. In the meantime since the solvent softened resin is tacky and adhesive the element unitizes or adheres together the shoe liner, the reinforcing element and the upper material into a single laminate, which in itself is very desirable.

As an alternative it has been proposed to use heat as the activating agent. While there has been some suggestion that webs impregnated with a thermosetting resin in its A or B stage be used, this has not proven to be very practical for several reasons, including, for example, the length of time needed to complete the reaction, the difficulty in controlling the reaction if the element is preheated, and the inherent lack of flexibility of the element even when reheated.

Thermoplastic resins on the other hand are much more practical. As is well known, with such resins, if the temperature is raised above the softening and melting point the resin becomes liquid. As soon as the temperature is lowered the resin resolidifies. Thus with the thermoplastic resins the reinforcing element should soften if the upper assembly is heated to the required temperature, should be reshapable if the upper is lasted while the reinforcing element is still at the requisite temperature and should reharden in the desired shape upon cooling on the last.

The thermoplastic stiffening elements have come in a number of forms. In most cases suitable fibrous webs have been impregnated with a thermoplastic resin. In other instances various types of laminates of resin and a suitable web or webs such as loosely woven fabric are provided. But any time that one tries to force a flat fibrous web into a complex shape there is a problem of bunching, of folding and of tearing. This is true even if the web is soaking wet and therefore the fibers have some freedom to move and to slide, as in the solvent-softened method outlined above. The problem is much more evident in cases where thermoplastic resins are used as an impregnant of or a laminate with a fibrous web.

Therefore it has been desirable to develop thermoplastic reinforcing elements that do not require the reinforcing effect of a fibrous web, but are sufficiently stiff in and of themselves at normal temperatures to properly stiffen and reinforce the shoe. On the other hand, the thermoplastic reinforcing element must become soft and pliable during the normal conditioning treatments of the shoe upper to mold and combine properly.

There are two basic types of pre-lasting conditioning treatments. In one, pre-assembled upper is enclosed in a rotary steam-fed activator. The purpose is not only to render the thermoplastic reinforcing element flaccid prior to molding on the cold (room temperature) last, but also to moisten and soften the upper leather. Though the steam temperature may be 212° F. the counter-blank between the inner liner and the shoe upper rarely reaches temperatures in excess of 175° to 180° F. The other conditioning method is to drape the heel portion of the assembled shoe upper with the reinforcing elements in place over a heated mold activator having a surface temperature in the range of 250° to 275° F. In order to prevent deterioration of the lining in the presence of these high temperatures the activation cycle is limited to relatively short periods. Here the reinforcing thermoplastic element may reach a temperature in the range of 200° to 225° F.

In modern shoe making procedures the upper, which has been pre-conditioned in the backpart area, is positioned on the foot form or last (assembling) and placed into a combination backpart molding-lasting machine that forms the counter to the desired shape as well as lasting in the heel seat.

In the next operation the toe area is pre-conditioned before pulling over and lasting. In both cases the purpose of the operation is to form the upper to the complex shape of the last or footform and to fasten the upper to the insole. This is basically accomplished by tensioning the upper as necessary and for this reason it is desirable in any case to subject the upper to a pre-lasting conditioning treatment.

Of course in an art such as shoe making there are many variations of procedure, depending for example, on the shoe maker, on the style of the shoe, etc. Thus, while pre-conditioning is normally employed, the conditioning can be accomplished by heating the foot form itself while shaping the upper to the foot form. Likewise a post-conditioning treatment is frequently employed wherein the upper is heated after it has been assembled on the foot form to further shape the shoe.

It should be considered that shoes of different styles, for different purposes, or made at different times or to sell in different areas may require widely varying degrees of stiffness or reinforcement. Whereas formerly hardness of counter was usually equated with quality and durability, the concept that a relatively soft and flexible counter can be both more comfortable and more durable is gradually becoming accepted with the advent of more modern materials. Many modern women's shoes of the more casual styles, for instance, are now made with counters and box toes of a softness that would have been considered unaccepatable a few years ago.

The problem is that plastic materials which are sufficiently stiff to provide, where the reinforcing element is of reasonable thickness, sufficient stiffening of the shoe at normal temperatures, generally have too high a melt point and too low a melt index to form properly during the lasting operation on a cold last after the pre-conditioning treatments outlined above. On the other hand, those resins which have a low enough melt point and a high enough melt index to form properly are insufficiently stiff at normal temperatures to properly reinforce the shoe.

We have discovered that if a resin having a low enough melt point and a high enough melt index or flow rate at the required temperature and pressure conditions is mixed with from 5 to 25 or 30, and preferably 10 to 18 per cent by weight of the total composition of chopped or milled glass fibers having a length of 1/32 to ½ inch and a sheet is formed from which the reinforcing elements may be died out, the resulting reinforcing elements are sufficiently flaccid at the temperature of the ordinary conditioning treatments to reform properly on a last and yet have adequate strength to provide the desired stiffness in the shoe at ordinary temperatures.

This combination has another and unexpected benefit in that the need for skiving is eliminated. Normally, in view of the fact that a stiffening element of whatever nature, in order to be sufficiently stiff must have a reasonable thickness it is necessary to skive the free edge of the element before assembly so that the bulk of the element will not be felt by the foot but rather the increase in thickness will be a gradual tapered edge which avoids producing an undesirable hump inside the finished shoe. Skiving is normally performed by a mechanical cutting action employing hand labor to fit each individual precut counter element. Skiving therefore is a relatively expensive operation. The expense and difficulty is increased with most thermoplastic materials since these materials tend to clog the blades of the skiving knife. We have found that, with the glass fiber reinforced plastic materials of my invention, mechanical skiving becomes totally unnecessary.

Under the normal temperature and pressure conditions involved in the backpart molding operation and in post-conditioning where employed, the sharp edge of the cut sheet tends to disappear, to feather out and thus make a gradual tapered edge. Depending upon such factors as the actual temperatures encountered and the relative tightness of the counter blank against the confines of the counter pocket, this thermal skiving action may be caused by either of two mechanisms. For instance, the forming and molding operation may cause resin to flow slightly forward into the unfilled space in the counter pocket. Alternatively, if the counter pocket is already filled, the squeezing action may result in displacement of resin back from the cut edge, leaving a tapered edge which might have a somewhat larger proportion of the glass fiber, and thus be stiffer proportionately than in the main stiffening element as a whole.

DETAILED DESCRIPTION

In essence we have discovered that certain of the so-called adhesive grade resins as contrasted to extrusion grade or molding grade resins which as a class were heretofore considered to be too soft and pliable to be useful in or as shoe stiffening elements, may be so used to great advantage when intimately admixed with short inert fibrous materials.

The materials that are useful can be identified by a modification of the test described in ASTM Method D1238 "Measuring Flow rates of Thermoplastics by Extrusion Plastometer," wherein the test conditions are modified to approximate the physical conditions encountered by the stiffening element in the backpart and forepart molding operations in a shoe factory. More specifically the procedure described in ASTM D1238 is performed at a temperature of 100° C. (212° F.) and at a pressure of 250 psi. We have found that the useful thermoplastic resins have a flow rate through the extrusion plastometer described therein in excess of 1 gram in every ten minutes and preferably in excess of 15 grams in every 10 minutes. Except for the variation in the specified temperature and pressure the flow rate test is conducted strictly in accordance with the procedures of ASTM Method D1238-62 T.

In addition the thermoplastic resin should have a softening point as measured in accordance with ASTM Method E 28-51T the so-called ball and ring softening point of at least 170° F. Resins having a softening point lower than this may become soft and tacky at temperatures which the footwear may encounter in normal use. There is no fixed and definite upper softening point limit since the limiting characteristic is the minimum flow rate as defined above. No two resins have the same melting characteristics and therefore it is impossible to predict from melt flow characteristics at more elevated temperatures and under different pressures what the flow characteristics would be under shoe molding conditions. In general, however, resins having a ball and ring softening point temperature in excess of about 275° F. probably would have an insufficient flow at 212° F. and 250 psi under the conditions described above to be useful.

There are a number of different classes of thermoplastic resins which meet these criteria. These include the polyamides, particularly those based in part on dimerized vegetable fatty acids. In addition, many of the polyolefins, particularly ethylene polymers and ethylene-vinyl acetate copolymers, as well as the ionomeric resin copolymers of alpha olefins with alpha, beta-ethylenically unsaturated monocarboxylic acids are useful. So also are certain saturated polyesters having low melting points.

The fibrous component may consist of any inert temperature resistant fibrous material in short lengths. While asbestos and other rock fibers may be used, the preferred material is glass fiber, either as uniform or random length chopped strands or milled fibers. The preferred length of the fibers is in the range of approximately 1/32 to ½ inch. These fibers may be treated in various ways such as by being coated with silene or starch and any of these are as useful as the uncoated fibers. Suitable chopped strands include those sold by Owens-Corning as No. K847 ⅛ inch and by PPG Fibers as No. 1156. A suitable milled fiber is one sold by Owens-Corning as No. 709 Type B 1/32 inch. The useful range is between about 10 and 18 per cent by weight. In addition, minor proportions of inert non-fibrous fillers may be used such as, for example, minor proportions of glass microspheres in the 10 to 300 micron diameter size.

The stiffening elements of the present invention are prepared by mixing the requisite quantity of inert fibers as well as inert non-fibrous fillers, if desired, with completely melted resin in, for example, a sigma blade mixer. Thereafter the molten mixture is formed into a sheet as by being extruded through a hot extrusion dye into the nip of water-cooled rolls. The finished sheet may be in the range of 0.005 to 0.075 inches thick with the preferred thickness being 0.030 to 0.035 inches. The material is supplied to the shoe factory in flat sheets or rolls of convenient dimensions and the individual stiffening elements are died out of the flat material as needed.

EXAMPLE I

A polyamide resin synthesized from the condensation of dimerized tall oil fatty acid with aliphatic diamines having a softening point range of 85° – 110° C. and a melt flow rate (ASTM D-1238 modified only by changing temperature to 100° C.) of 50 grams/10 minutes at 250 psi was extruded by conventional means into sheet 0.035 inches thick.

In a shoe factory the sheet was died out into flat counter-blanks to a pattern appropriate to the shoes being manufactured. The individual counter-blanks, without any prior mechanical skiving or feathering of the edges, were then inserted into the counter pockets of the shoe uppers. Each shoe upper, with the counter-blank in the counter pocket was subjected to a heat activation process utilizing steam for approximately 30 seconds, thus raising the counter to a temperature of about 170° to 190° F. Examination indicated that the counter-blank had become tacky and flaccid at this temperature. The heat activated upper was immediately placed on a foot form or last, then molded in a conventional backpart molding machine in which uniform pressure is exerted upon the counter area as the shoe cools down in temperature. After all subsequent shoe making operations were completed and the shoe was finished, it was removed from the last and the counter area examined carefully. The counter exhibited an excellent appearance, resilience and feel, with good three-dimensional, wrinkle-free molding. Especially notable was the smooth top line and tapering of the edges of the counter.

Examination of a cut-away cross-section showed that excellent backpart unitization had occurred, as the upper material, the sheet counter, and lining material were strongly laminated together throughout the counter area. Clearly the flat counter blank had exhibited sufficient flow and adhesiveness to achieve these results, including the thermal skiving along the top line and the other edges of the counter. However, the stiffness was judged to be relatively soft, in fact not acceptable by present standards.

EXAMPLE II

Example I was repeated but this time 5 parts by weight of ⅛th inch chopped strand glass fibers were mixed with 95 parts by weight of the polyamide resin utilizing a sigma blade type mixture and was extruded by conventional means into sheet 0.035 inches thick. Again as in Example I each shoe upper with the insert counter-blank in the counter pocket was subjected to the heat activation process utilizing steam for approximately 30 seconds and thereafter the heat activated upper was immediately placed on a last and molded in a conventional backpart molding machine.

After all subsequent shoe operations were completed and the shoe was finished, it was removed from the last and the counter area examined carefully. As in Example I the counter exhibited an excellent appearance, resilience and feel, with good three-dimensional, wrinkle-free molding. There was excellent backpart unitization and thermal skiving had occured to produce a smooth top line and tapering of the edges of the counter. The most notable difference from Example I was that in this case, while the counter area was still relatively soft, there was sufficient stiffness to be acceptable, especially where a particularly soft and flexible shoe is desired.

EXAMPLE III

Eighty-seven parts by weight of a polyamide resin synthesized from the condensation of dimerized tall oil fatty acid with aliphatic diamines having a softening point range of 85° to 110° C. and a melt flow rate (ASTM D-1238 modified only by changing temperature to 100° C.) of 50 grams/10 minutes at 250 psi was blanded with 13 parts by weight of ⅛ inch chopped strand glass fibers utilizing a sigma blade type mixer and extruded by conventional means into sheet 0.030 inches thick.

As in Example I, the sheet was died out into counter-blanks which were then inserted into the counter pockets of shoe uppers. Each shoe upper was then subjected to a heat activation process in which the upper was draped by its counter portion on an aluminum form designed for this purpose and maintained at a temperature of about 250° to 275° F. Examination after 12 to 15 seconds exposure to this heat indicated that the counter-blank had become tacky and flaccid and was judged to be at a temperature of approximately 210° to 215° F. The heat activated upper was then placed on a last, molded on a backpart molding machine and made into a finished shoe as in Example I. Examination of the shoe indicated excellent appearance, resilience, and feel, with good three-dimensional, wrinkle-free molding. The counter top line was smooth and the tapering of the edges of the counter was good, resulting in a smooth tapered transition that was difficult to detect. Especially notable was the increased stiffness of the counter area which was judged to be acceptable for women's shoes. Detailed examination of several shoes including cut-away cross-sections showed excellent three-dimensional molding without bunching or wrinkling, excellent backpart unitization, and that thermal skiving had occurred to produce the smooth top line and the smoothly tapered leading edges of the counter. When the shoes were subjected to wear testing, the durability and performance of the counter was judged to be excellent in that the counter areas maintained their shape and resilience while other parts of the shoe had broken down.

EXAMPLE IV

Example III was repeated using 75 parts by weight of the polyamide resin to 25 parts by weight of the ⅛ inch chopped strand glass fibers. By comparison with Example III, the molten mix was relatively dry but still could be extruded by conventional means into sheet 0.030 inches thick. Counter-blanks died from the sheet were inserted into the counter pockets of shoe uppers and each shoe upper was activated by being draped on an aluminum form maintained at a temperature of about 250° to 275° F. for 12 to 15 seconds. The activated upper was then immediately placed on a last and molded on a backpart molding machine. Examination of the finished shoe indicated excellent appearance and feel with good three-dimensional wrinkle-free molding. There was fairly good backpart unitization and while the thermal skiving effect was less pronounced than in Example III, the top line remained smooth and the leading edges of the counter were fairly smoothly tapered. Especially notable was the relative stiffness of the tapered edges due to the high proportion of glass fibers therein. The counter area of the finished shoe was quite stiff and only slightly resilient.

EXAMPLE V

Eighty parts of a copolymer of ethylene and vinyl acetate having a melt flow rate (ASTM D-1238 modified only in temperature change to 100° C.) of 30 grams/10 minutes at 250 psi was blended with twenty parts by weight of ⅛ inch chopped strand glass fiber in a sigma blade type mixer and then extruded into sheet 0.040 inches thick.

As in Example I, the sheet was died out into counter-blanks which were then inserted into the counter pockets of shoe uppers. Each shoe upper was then subjected to a heat activation process in which the upper was draped by its counter portion on an aluminum form designed for this purpose and maintained at a temperature of about 250° to 270° F. Examination after 12 to 15 seconds exposure to this heat indicated that the counter-blank had become tacky and flaccid and was judged to be at a temperature of approximately 210° to 215° F. The heat activated upper was then placed on a last, molded on a backpart molding machine and made into a finished shoe as in Example L. Examination of the shoes indicated excellent appearance, resilience, and feel, with good three-dimensional, wrinkle-free molding. The top line was smooth and the tapering of the edges of the counter was good, resulting in a smooth tapered transition that was difficult to detect. Especially notable was the increased stiffness of the counter area which was judged to be acceptable for certain casual footwear. Detailed examination of several shoes including cut-away cross-sections showed excellent three-dimensional molding without bunching or wrinkling, excellent backpart unitization, and that thermal skiving had occurred to produce the smooth top line and the smoothly tapered leading edges of the counter. When the shoes were subjected to wear testing, the durability and performance of the counter was judged to be excellent.

EXAMPLE VI

An ionomeric resin copolymer of alpha-olefins, alpha, beta-ethylenically unsaturated monocarboxylic acid and randomly distributed metal ions (tradename Surlyn A), and having a softening point range of 195° F. was extruded by conventional means into sheet 0.030 inches thick. The ionomeric resin shows a melt flow rate (ASTM D-1238 modified only by changing temperature to 100°C.) of less than 0.1 grams/10 minutes at 250 psi. To properly describe the flow rate, it is noted that the melt flow rate at 190° C. (ASTM D-1238 unmodified) is listed in trade literature as being 1.2 grams/10 minutes.

As in Example I, the sheet was died out into counter-blanks which were then inserted into the counter pockets of shoe uppers. Each shoe upper was then subjected to a heat activation process in which the upper was draped by its counter portion on an aluminum form designed for this purpose and maintained at a temperature of about 250° to 275° F. Examination after 12 to 15 seconds exposure to this heat indicated that the counter-blank had become flaccid and somewhat tacky at a temperature judged to be approximately 210° to 215° F. After completion of the shoes as in Example I, the shoes were removed from the last and the counter area examined carefully. It was noted that whereas molding had essentially occurred, there was some bunching or wrinkling and that the sharp edges of the counter were both visible from the outside and could be felt from the inside of the shoe. The stiffness obtained was relatively good. Some small degree of lamination had occurred, but this was judged to be superficial and it was clear that backpart unitization had not in fact occurred. Examination of cut-away cross-sections showed that thermal skiving had not occurred and that the sharp edges of the counter remained relatively unchanged. Thus, it was concluded that the use of a resin of these characteristics would require the application of an adhesive coat, mechanical skiving of the died out counter-blanks before insertion and abnormally high activation temperatures.

Normally thermoplastic resins of the group included in the scope of this invention are self-adhesive at the normal activating and/or conditioning temperatures resulting in the complete unitization of the shoe parts with the reinforcing elements. Since the unitizing effect is important in obtaining the proper degree of stiffness, in those cases where a particular resin becomes insufficiently tacky as to be self-adhesive at the activating temperatures to provide a good bond and complete lamination in the finished shoe, a relatively thin surface coating of a lower melting point and more tacky resin may be applied to the resin-fiber composite sheet to improve adhesion and bonding.

In addition, as pointed out above, the presence of a fabric layer, whether it be woven or non-woven, interferes in the molding action and often results in wrinkling or bunching of the reinforcing element in the finished shoe. While we prefer not to use any type of fabric in connection with our reinforcing material, there are some instances where a particular shoe has no lining and stitched counter pockets. In such instances, one surface of our reinforcing material may be faced either with flocking or a fabric having flocking, the purpose of which is to provide a decorative and protective surface on the inside of the shoe next to the foot.

We claim:

1. A method of stiffening a selected portion of a shoe upper which comprises providing a stiffening element in flat unskived form, said element consisting essentially of a thermoplastic resin having a melt flow rate of at least 1 gram in 10 minutes at 100° C. and 250 p.s.i. as defined, intimately admixed with from 5 to 30 per cent by weight of the total composition of randomly dispersed short inert fibers, assembling said element with a selected portion of said shoe upper to form a shoe upper assembly, heating said assembly to an elevated temperature at which said stiffening element becomes flaccid and moldable, forming and molding said assembly to the shape of a foot form by the application of pressure while said stiffening element is at said elevated temperature, causing said stiffening element to acquire the shape of that portion of the form with which it is associated, at least one free edge of said stiffening element flowing sufficiently to form a tapered or skived edge, and permitting said assembly to cool sufficiently for said stiffening element to regain its normal hardened condition while in contact with said form.

2. The method as claimed in claim 1, wherein said resin has a ball and ring softening point in excess of about 170° F.

3. The method as claimed in claim 1, wherein said fibers are glass fibers.

4. The method as claimed in claim 3, wherein said glass fibers have a length in the range of about 1/32 inch to about ½ inch.

5. The method as claimed in claim 1, wherein said thermoplastic resin is a polyamide or a polyolefin.

6. The method as claimed in claim 1, wherein said stiffening element is tacky and adhesive when in its flaccid and moldable condition and upon cooling adhesively bonds to adjoining portions of said upper.

* * * * *